United States Patent [19]

Koyama et al.

[11] Patent Number: 4,507,946

[45] Date of Patent: Apr. 2, 1985

[54] METHOD AND SYSTEM FOR CONTROLLING AN INTERSTAND TENSION IN A CONTINUOUS ROLLING MILL

[75] Inventors: Toshihiro Koyama, Koganei; Yoshiharu Anbe, Kodaira; Takuo Funahashi, Hino, all of Japan

[73] Assignee: Tokyo Shibaura Denki Kabushiki Kaisha, Kawasaki, Japan

[21] Appl. No.: 486,354

[22] Filed: Apr. 19, 1983

[30] Foreign Application Priority Data

Apr. 23, 1982 [JP] Japan ..... 57-68276

[51] Int. Cl.[3] ..... B21B 37/00

[52] U.S. Cl. ..... 72/17; 72/205

[58] Field of Search ..... 72/17, 18, 366, 10, 72/205

[56] References Cited

FOREIGN PATENT DOCUMENTS 53810 5/1981 Japan ..... 72/10

*Primary Examiner*—Lowell A. Larson
*Assistant Examiner*—Jorji M. Griffin
*Attorney, Agent, or Firm*—Schwartz, Jeffery, Schwaab, Mack, Blumenthal & Koch

[57] ABSTRACT

In a method and a system for controlling an interstand tension in a continuous rolling mill having a looper provided between a pair of successive rolling stands and driven by a looper drive motor, a correction to the speed target value for the looper drive motor is determined in accordance with the deviation of a detected looper operating angle from an angle target value, and the looper drive motor is controlled in accordance with the speed of corrected speed target value.

2 Claims, 2 Drawing Figures

METHOD AND SYSTEM FOR CONTROLLING AN INTERSTAND TENSION IN A CONTINUOUS ROLLING MILL

BACKGROUND OF THE INVENTION

The present invention relates to method and a system for controlling an interstand tension in a continuous rolling mill.

Most important factors for evaluating the quality of products rolled in the continuous rolling mills are thickness and width of sheet; the amount of crowning and flatness. These factors are greatly affected by an interstand tension i.e., a tension exerted on the workpiece passing between two successive rolling stands. The variation in the interstand tension must therefore be kept as small as possible. For this reason, hot continuous rolling mills are provided with a looper between successive rolling stands to minimize variation in the tension. In addition, the speed of the rolling stand adjacent the looper is controlled to minimize the range of angle over which the looper swings.

FIG. 1 shows an example of a conventional tension control system. A workpiece 1 to be rolled passes through a rolling stand 2 having a pair of working rolls 2*a* and 2*b*, engages with a looper 4 and then passes through another rolling stand 3 having a pair of working rolls 3*a* and 3*b*. The looper 4 is of a type with which the looper torque given by a looper drive motor 8 is in balance with the tension on the workpiece 1. The operating angle $\theta$, i.e., the angle between the axis of the arm 4*a* of the looper 4 and an imaginary horizontal line 4*b* is detected by a looper angle sensor 5. The detected angle $\theta$ is applied to an operation unit 6 which computes, in accordance with the detected angle $\theta$, the torque to maintain the tension at a desired value. More particularly, the detected angle $\theta$ is used for the calculation by the looper operation unit 6 to determine the target value of the electric current of the looper drive motor 8, and the target value is supplied to a current control device 7 which drives the looper drive motor 8.

The output from the looper angle sensor 5 is also fed to an operation unit 9 which computes a target value of the speed of a roll drive motor 11 to return the angle $\theta$ to a desired value. The speed target value is applied to a speed control device 10 which controls the speed of the roll drive motor 11.

The control system described above, however, has the following drawbacks. First, since a current control device 7 is used to control the looper drive motor 8, a circuit for compensation for stabilization is required, and it is necessary to compute the initial current target value.

Secondly, the change of the speed of the roll drive motor 11 results in variation of the length of the workpiece 1 between the successive rolling stands 1 and 2, following which the looper angle control is made. As a result, considerable variations occur in the tension on the workpiece.

Thirdly, making the looper angle control to reduce the variation in tension necessitates lowering the response of control. This degrades the capability of the system to follow rapidly changing disturbance.

SUMMARY OF THE INVENTION

An object of the invention is to eliminate the drawbacks of the conventional control system.

Another object of the invention is to provide an interstand tension control method which can be implemented by a system of a simpler construction.

Another object of the invention is to provide an interstand tension control system of a simpler construction.

Another object of the invention is to provide a method and a system for interstand tension control having a quick response.

Another object of the invention is to provide a method and a system for interstand tension control with which the variation in the tension can be reduced.

According to one aspect of the invention, there is provided a method for controlling an interstand tension in a continuous rolling mill having a looper provided between a pair of successive rolling stands and driven by a looper drive motor, said method comprising:

detecting the operating angle of the looper, and determining, in accordance with the deviation of the detected angle from an angle target value, a correction to the speed target value for the looper drive motor, the looper drive motor being controlled in accordance with the speed target value.

According to another aspect of the invention, there is provided a system for controlling an interstand tension in a continuous rolling mill having a looper provided between a pair of successive rolling stands and driven by a looper drive motor, said system comprising:

means for detecting the operating angle, means for determining a deviation of the detected angle from an angle target value, means responsive to the deviation of the detected angle for determining a correction to a speed target value of the looper drive motor, and a looper drive motor speed control device responsive to the correction for controlling the speed of the looper drive motor.

DESCRIPTION OF THE PREFERRED EMBODIMENT

Figure 1:
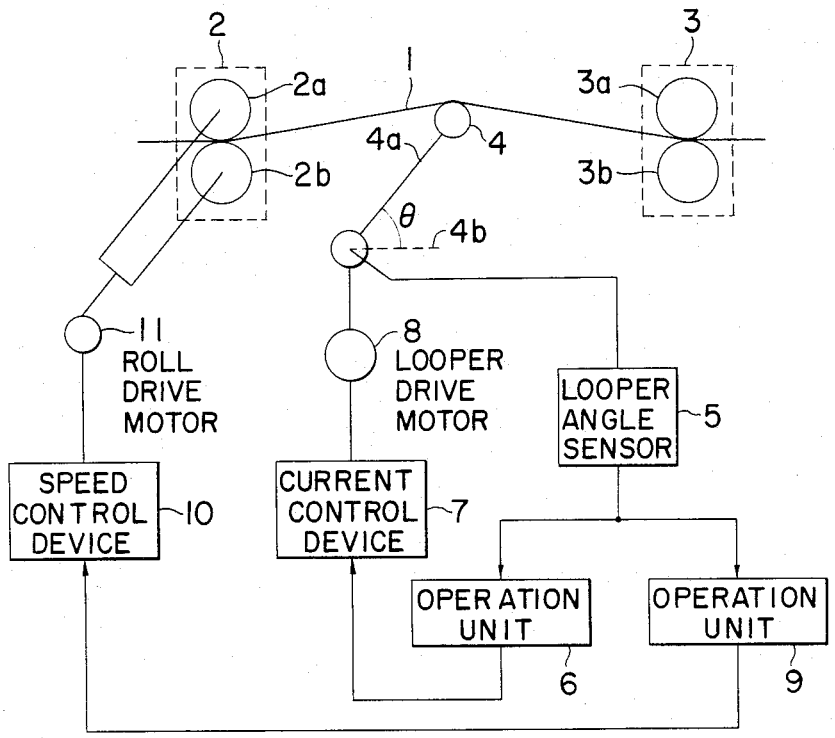
PRIOR ART FIG. 1
FIG. 1 is a diagram showing a prior art control system used in a continuous rolling mill.
Figure 2:
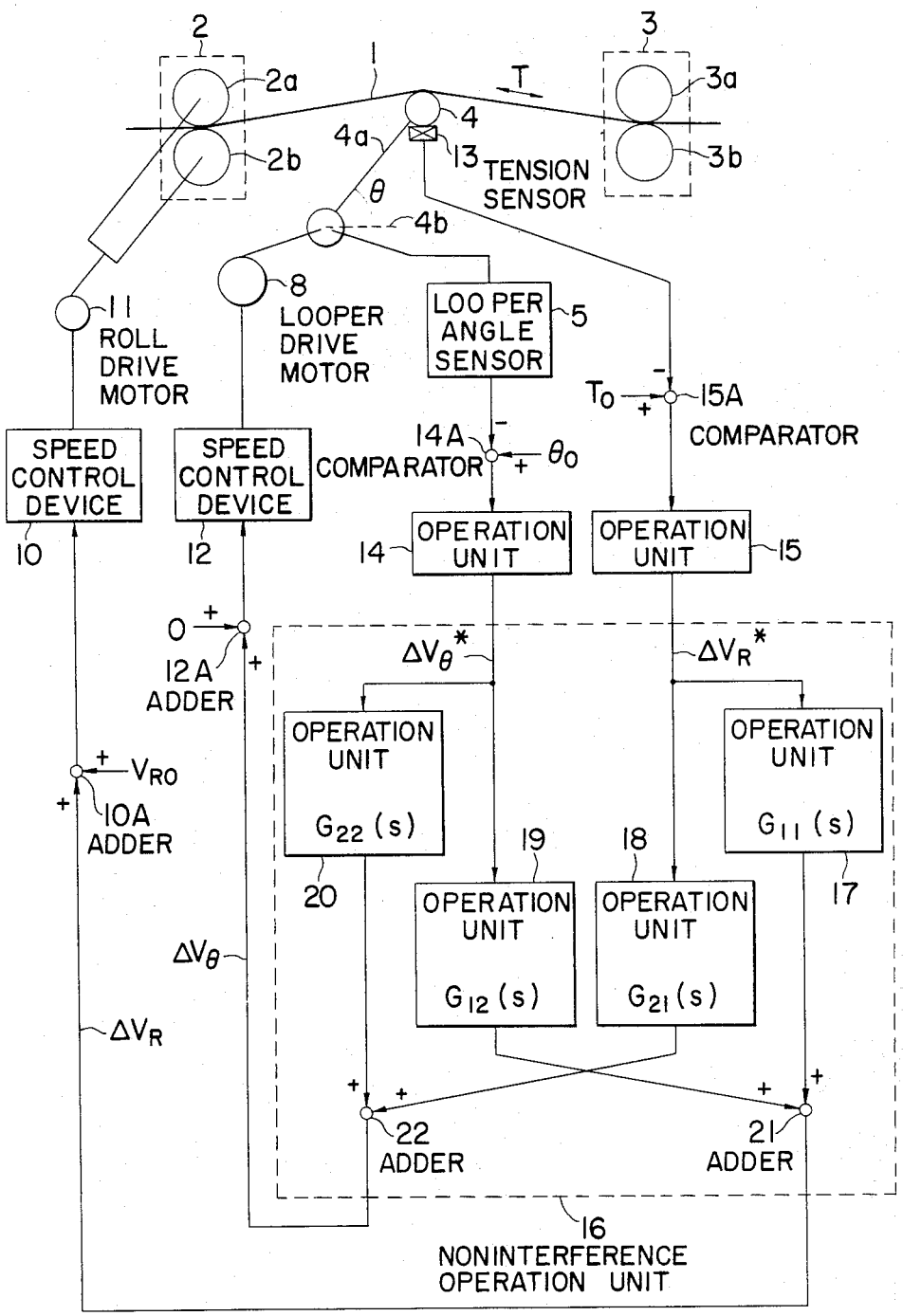
FIG. 2 is a diagram showing an embodiment of a control system in accordance with the present invention.

FIG. 2 shows a preferred embodiment of a looper control system according to the present invention, in which the same reference numerals as in FIG. 1 designate similar elements. In place of the operation units 6 and 9 in FIG. 1, a motor speed control unit 10 and operation units 14 and 15 and a noninterference operation unit 16 are provided. In addition, a tension sensor 13 is provided to detect the interstand tension, i.e., the tension on the workpiece 1 between the successive rolling stands 2 and 3.

A comparator 15A determines the deviation of the detected tension T from the tension sensor 13 with reference to a tension target value $T_0$. The deviation is applied to the operation unit 15 which performs P (proportional) and I (integral) control operation to determine a speed compensation $\Delta V_R^*$. A comparator 14A determines the deviation of the detected angle $\theta$ with reference to an angle target value $\theta_0$. The deviation is applied to the operation unit 14 which also performs PI control operation to determine a speed compensation $\Delta V_Q^*$.

The noninterference operation unit 16 comprises operation units 17, 18, 19 and 20, and adders 21 and 22. The speed compensation $\Delta V_R^*$ is applied to the operation units 17 and 18, while the speed compensation $\Delta V_\theta^*$ is applied to the operation units 19 and 20. The adder 21 determines the sum of the outputs from the operation units 17 and 19, while the adder 22 determines the sum of the outputs from the operation units 18 and 20. The output $\Delta V_R$ from the adder is applied, as a speed correction, via an adder 10A to the speed control device 10 while the output $\Delta V_\theta$ is applied, as a speed correction, via an adder 12A to the speed control device 12.

The purpose of providing the noninterference operation unit 16 is as follows. The relationship between, on one hand, the speed correction $\Delta V_R$ actually fed to the speed control device 10 for the roll drive motor 11, and the speed correction $\Delta V_\theta$ actually fed to the speed control device 12 for the looper drive motor 8, and, on the other hand, the variation $\Delta T$ in tension and the variation $\Delta\theta$ in looper angle may be expressed by the following transfer-function matrtix:

$$\begin{bmatrix} \Delta T \\ \Delta\theta \end{bmatrix} = \begin{bmatrix} P_{11}(s) & P_{12}(s) \\ P_{21}(s) & P_{22}(s) \end{bmatrix} \begin{bmatrix} \Delta V_R \\ \Delta V_\theta \end{bmatrix} \quad (1)$$

where s is the Laplace transform variable.

The Eq. (1) shows that the speed correction $\Delta V_R$ intended for correction of the tension variation $\Delta T$ also affects the looper angle variation $\Delta\theta$, while the speed correction $\Delta V_\theta$ intended for correction of the angle variation $\Delta\theta$ also affects the tension variations $\Delta T$.

It follows that if the noninterference operation unit 16 were not provided and the speed compensation $\Delta V_\theta^*$ were used as the signal $\Delta V_\theta$ to be applied to the control device 12 and the speed compensation $\Delta V_R^*$ were used as the signal $\Delta V_R$ to be applied to the control device 10, mutual interference would occur. This is the reason why the present invention provides the noninterference operation unit 16 which receives the speed compensations $\Delta V_R^*$ and $\Delta V_\theta^*$ and generates the speed corrections $\Delta V_R$ and $\Delta V_\theta$ to avoid the interference.

The operation units 17–20 are so formed as to have transfer functions with the following relationships between them. The operation unit 19 has such a transfer function as produces an output of a value contributing to a speed variation of the roll drive motor 11 for cancelling the interstand tension variation due to the looper angle variation due to the output of the operation unit 20. In other words, the output of the operation unit 19 is determined to counteract the attendant effect on the interstand tension of the output of the operation unit 20. The operation unit 18 has such a transfer function as produces an output of a value contributing to a speed variation of the looper drive motor 8 for cancelling the looper angle variation due to the interstand tension variation due to the output of the operation unit 17. In other words, the output of the operation unit 18 is determined to counteract the attendant effect on the looper angle of the output of the operation unit 17.

The transfer functions that satisfy the above-mentioned requirements can be determined based upon the following consideration. Let the transfer functions of the operation units 17–20 be designated by $G_{11}(s)$, $G_{12}(s)$, $G_{21}(s)$ and $G_{22}(2)$, respectively, then we have the following relationship:

$$\begin{bmatrix} \Delta V_R \\ \Delta V_\theta \end{bmatrix} = \begin{bmatrix} G_{11}(s) & G_{12}(s) \\ G_{21}(s) & G_{22}(s) \end{bmatrix} \begin{bmatrix} \Delta V_R^* \\ \Delta V_\theta^* \end{bmatrix} \quad (2)$$

If the transfer functions have the following relationships:

$$\left.\begin{aligned} \frac{G_{11}(s)}{G_{21}(s)} &= -\frac{P_{22}(s)}{P_{21}(s)} \text{ and} \\ \frac{G_{22}(s)}{G_{12}(s)} &= -\frac{P_{11}(s)}{P_{12}(s)} \end{aligned}\right\} \quad (3)$$

then Eqs. (1), (2) and (3) can be rewritten as follows:

$$\begin{bmatrix} \Delta T \\ \Delta\theta \end{bmatrix} = \begin{bmatrix} P_{11}(s) & P_{12}(s) \\ P_{21}(s) & P_{22}(s) \end{bmatrix} \begin{bmatrix} G_{11}(s) & G_{12}(s) \\ G_{21}(s) & G_{22}(s) \end{bmatrix} \begin{bmatrix} \Delta V_R^* \\ \Delta V_\theta^* \end{bmatrix} = \quad (4)$$

$$\begin{bmatrix} P_{11}(s)G_{11}(s) + P_{12}(s)G_{21}(s) & P_{11}(s)G_{12}(s) + P_{12}(s)G_{22}(s) \\ P_{21}(s)G_{11}(s) + P_{22}(s)G_{21}(s) & P_{21}(s)G_{12}(s) + P_{22}(s)G_{22}(s) \end{bmatrix} \begin{bmatrix} \Delta V_R^* \\ \Delta V_\theta^* \end{bmatrix} =$$

$$\begin{bmatrix} P_{11}(s)G_{11}(s) + P_{12}(s)G_{21}(s) & 0 \\ 0 & P_{21}(s)G_{21}(s) + P_{22}(s)G_{22}(s) \end{bmatrix} \begin{bmatrix} \Delta V_R^* \\ \Delta V_\theta^* \end{bmatrix}$$

Eq. (4) shows a situation wherein the compensation $\Delta V_R^*$ affects only the tension variation $\Delta T$ while the compensation $\Delta V_\theta^*$ affects only the looper angle variation $\Delta\theta$. In other words, if the transfer functions of the units 17–20 satisfy the relationships given by Eq. (3), the above-described mutual interference can be eliminated.

To prevent the transfer functions, respectively, of the main feedback loops (for controlling the looper drive motor 8 in response to the detected looper angle $\theta$ and for controlling the roll drive motor 10 in response to the detected tension) from becoming complicated, it is preferable that $G_{11}$ and $G_{22}$ are simple constants, e.g., $$G_{11} = -1$$

$$G_{22} = +1$$

The speed correction $\Delta V_R$, which is the output from the noninterference operation unit 16, is added at an adder 10A to an initial speed set value $V_{R0}$ and the sum is fed to the speed control device 10, and is used to correct the speed of the roll drive motor 11. The speed correction $\Delta V_\theta$, which is another output from the noninterference operation unit 16, is fed to the speed control device 12, and is used to correct the speed of the looper drive motor 8.

If the mutual interference is eliminated in the manner described above, the variations in the interstand tension can be substantially reduced. In addition, quick response in control is achieved.

Where it is difficult to form operation units that exactly satisfy Eq. (3), that is, if it is difficult to form operation units with the transfer functions $G_{11}(s)$, $G_{12}(s)$, $G_{21}(s)$ and $G_{22}(s)$ satisfying Eq. (3), the arrangement may be alternatively such that the relations of Eq. (3) are approximately satisfied with a limited frequency range. Such an arrangement can result in similar effects.

In the embodiment described above, the units 14 and 15 perform PI control operation. They may however be ones performing P, I, D (differential) control operation.

In the embodiment described, the roll drive motor 11 for the stand 2 positioned upstream of the looper is controlled, but the arrangement may alternatively be such that a roll drive motor for the stand 3 downstream of the looper is controlled.

In the above embodiment, in which not only the looper drive motor but also the roll drive motor is controlled, has the additional advantage of eliminating the mutual interference. It should however be noted that the control of the roll drive motor as explained is not an essential element. The use of the tension deviation for the looper drive motor control is not an essential element, either. The essence of the invention resides in the control of speed rather than current of the looper drive motor and the primary merit thereof is simplification of the control system. That is, if the current control device 7 is used as shown in FIG. 1 to control the looper drive motor 8, there are disadvantages in that a circuit for compensation is needed for stabilizing the control system and the computation of an initial current set value is needed. In contrast, the present invention adopts the speed control of the looper, and is free from these disadvantages. In addition, since the speed of the looper drive motor 8 is zero when the looper 4 is stopped, the initial speed set value can be determined at 0.

What is claimed is:

1. A method for controlling an interstand tension in a continuous rolling mill having a looper provided between a pair of successive rolling stands and driven by a looper drive motor, said method comprising the steps of:

detecting the operating angle of the looper;

detecting the interstand tension;

determining, in accordance with a detected deviation of said detected operating angle from an angle target value, and in accordance with a detected deviation of said detected tension from a tension target value, a correction to a speed target value for speed feedback control of the looper drive motor and a correction to a speed target value for a roll drive motor driving one of the rolling stands between which the looper is provided;

the step of determination of a correction to the speed target value for the looper drive motor comprising the steps of:

determining a first correction from the deviation of the detected angle, determining a second correction from the deviation of the detected tension, and adding the first correction and the second correction to produce the correction to the speed target value for the looper drive motor;

the step of determination of the correction to the speed target value for the roll drive motor comprising the steps of:

determining a third correction from the deviation of the detected tension, determining a fourth correction from the deviation of the detected angle, and adding the third correction and the fourth correction to produce the correction to the speed target value for the roll drive motor;

the fourth correction being determined to be a value contributing to a variation in the speed of the roll drive motor cancelling the variation in the tension due to the variation in the angle due to the first correction; and the second correction being determined to be a value contributing to a variation in the speed of the looper drive motor cancelling the variation in the angle due to the variation in the tension due to the third correction.

2. A system for controlling an interstand tension in a continuous rolling mill having a looper provided between a pair of successive rolling stands and driven by a looper drive motor, said system comprising:

means for detecting the operating angle of the looper;

means for determining a deviation of the detected angle from an angle target value;

means for detecting the interstand tension;

means for determining a deviation of said detected interstand tension from a tension target value;

means responsive to the determined angle deviation and to the detected tension variation for determining a correction to a speed target value for speed feedback control of the looper drive motor, and for determining a correction to a speed target value for a roll drive motor driving one of the rolling stands between which the looper is provided;

a looper drive motor speed control device, responsive to the correction to the looper drive motor speed target value, for controlling the speed of the looper drive motor; and a roll drive motor speed control device, responsive to the correction to the roll drive motor speed target value, for controlling the speed of the roll drive motor; wherein said means for determining the correction to the speed target value for the looper drive motor comprises means for determining a first correction in accordance with the deviation of the detected angle, means for determining a second correction in accordance with the deviation of the detected tension, and means for adding the first correction and the second correction to produce the correction to the speed target value for the looper drive motor;

said means for determining the correction to the speed target value for the roll drive motor comprises means for determining a third correction in accordance with the deviation of the detected tension, means for determining a fourth correction in accordance with the deviation of the detected angle, and means for adding the third correction and the fourth correction to produce the correction to the speed target value for the roll drive motor;

said means for determining the fourth correction has a transfer function to produce the fourth correction of a value contributing to a variation in the speed of the roll drive motor cancelling the variation in the tension due to the variation in angle due to the first correction; and said means for determining the second correction has a transfer function to produce the second correction to a value contributing to a variation in the speed of the looper drive motor cancelling the variation in the angle due to the variation in the tension due to the third correction.

* * * * *